United States Patent [19]

DeLuca et al.

[11] Patent Number: 4,576,428

[45] Date of Patent: Mar. 18, 1986

[54] PROTECTIVE BOOT FOR TELEPHONE SUBSCRIBER JACKS

[75] Inventors: Paul V. DeLuca, Plandome Manor; Peter Hung, Huntington, both of N.Y.

[73] Assignee: Porta Systems Corp., Syosset, N.Y.

[21] Appl. No.: 665,661

[22] Filed: Oct. 29, 1984

[51] Int. Cl.[4] ..... H01R 4/00

[52] U.S. Cl. ..... 339/94 R; 339/213 R; 339/61 R

[58] Field of Search ..... 339/103 R, 103 B, 59–61, 339/63, 94, 201, 126 RS, 42, 43, 213 R

[56] References Cited

U.S. PATENT DOCUMENTS

| | | | |
|---|---|---|---|
| 2,869,100 | 1/1959 | Adams | 339/61 L |
| 3,088,089 | 4/1963 | Gregoire | 339/42 |
| 3,742,426 | 6/1973 | Huber et al. | 339/42 |
| 4,194,801 | 3/1980 | Fitzler et al. | 339/59 M |
| 4,220,387 | 9/1980 | Biche et al. | 339/61 R |
| 4,391,481 | 7/1983 | Golden | 339/42 |

FOREIGN PATENT DOCUMENTS

| | | | |
|---|---|---|---|
| 2344147 | 10/1977 | France | 339/42 |

*Primary Examiner*—Gil Weidenfeld
*Assistant Examiner*—David L. Pirlot
*Attorney, Agent, or Firm*—Charles E. Temko

[57] ABSTRACT

A flexible resilient protective boot for shielding an engaged telephone subscriber plug and jack interconnection against moisture, vermin, insects and the like. The boot is suitable for installation by the subscriber without the use of tools and employing only ordinary skill. In each of the embodiments, the boot comprises a pair of separable members which are spreadable to enclose part of the plug structure, and resilient means engaging said separable members to maintain them in abutted relation.

4 Claims, 4 Drawing Figures

PROTECTIVE BOOT FOR TELEPHONE SUBSCRIBER JACKS

BACKGROUND OF THE INVENTION

This invention relates generally to the field of telephony, and more particularly to an improved resilient boot serving to completely enclose the interconnection between an on-premises plug and jack interconnection of a single subscriber pair to protect the same from entry of moisture, insects and other contaminants.

With the advent of subscriber-owned equipment and the increase of installation of this equipment by the subscriber, there has arisen the need to provide a variety of equipment requiring little or no skill to install. The most common installation is the wall or baseboard mounting of an RJ 11 jack into which the already attached plug of a telephone handset is engaged to interconnect the handset to the subscriber pair.

While the RJ 11 construction has gained practically universal acceptance because of its simplicity of connection and disconnection, it is not without shortcomings. As contrasted with older type plug and jack connections, which it has replaced, contacts are of very small cross section, i.e., the abutment of the surfaces of very fine conductor wires. The common types of older construction, by contrast, employed pins and corresponding sockets of diameter approximating 1/16 inch, with correspondingly greater contact area. As a result, depending upon the locale of installation, many RJ 11 plug and jack interconnections are subject to the deleterious effects of moisture, insects, vermin and other contaminants which enter the effective contacted areas and cause excessive noise on the subscriber line.

While the use of rubber or synthetic rubber boots for moisture proofing in the electric and electronic fields is not new, the problem of consumer installation in the case of a boot for use with RJ 11 interconnections is caused by the fact that subscriber equipment, when purchased, already has the plug element installed on the lead. The external configuration of the plug, including the resilient latch member makes it difficult to stretch a boot over the plug where a portion of the boot may then contract upon the lead interconnecting the plug to the handset.

SUMMARY OF THE INVENTION

Briefly stated, the invention contemplates the provision of an improved boot suitable for enclosing the locus of interconnection between an RJ 11 plug and jack to effectively seal the jack opening against entry of contaminants which may impair conductivity of the interconnection. The invention further contemplates the provision of a boot including a pair of symmetrical and separable elements which are adapted to enclose the plug and adjacent conductor to be mated in abutted relation by a separate resilient element. When installed, the boot provides a free end thereon which selectively abuts the planar surface of the jack surrounding the plug opening under stress. In one embodiment, the boot has a tail section which is bifurcated and maintained closed by a pair of resilient cinctures. In another embodiment, a pair of relatively rigid captive elements surround the conductor at the tail portion of the jack, and a relatively thin boot element resiliently encloses the pair of captive elements and the plug as well.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
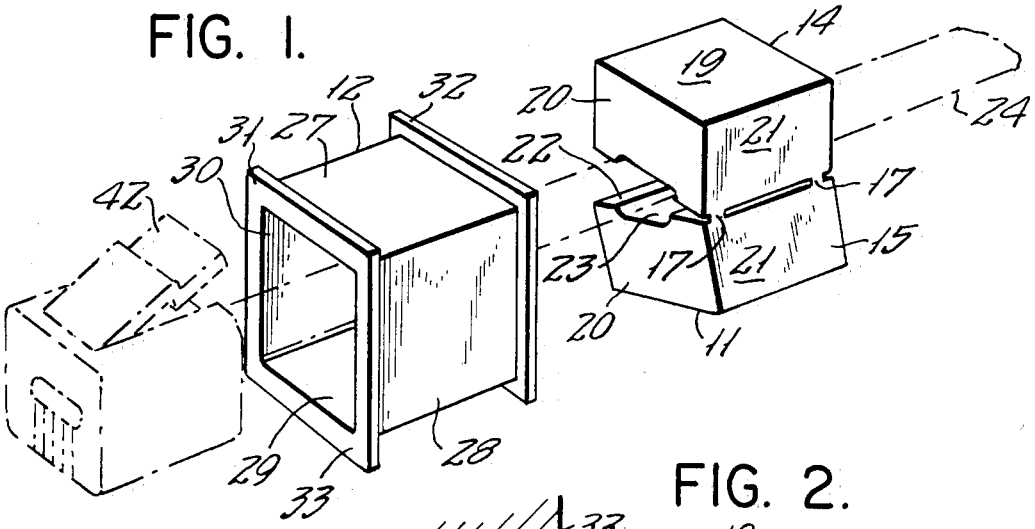
FIG. 1 is an exploded view in perspective of a first embodiment of the invention.

In accordance with the first embodiment of the invention, the device, generally indicated by reference character 10, comprises broadly: an inner boot element 11 and an outer boot element 12.

The inner boot element 11 includes first and second elongated members 14 and 15, respectively which are preferably interconnected by a captive hinge structure 17. The element 11 is preferably injection molded as a unit from soft rubber or resilient synthetic resinous materials.

Figure 2:
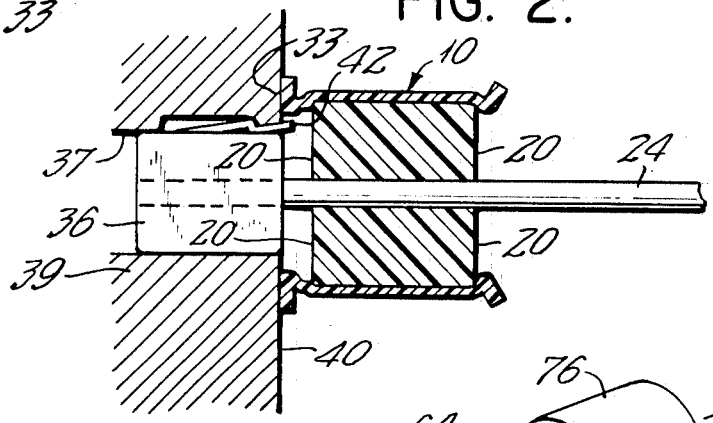
FIG. 2 is a longitudinal central sectional view of the first embodiment in installed condition.
Figure 3:
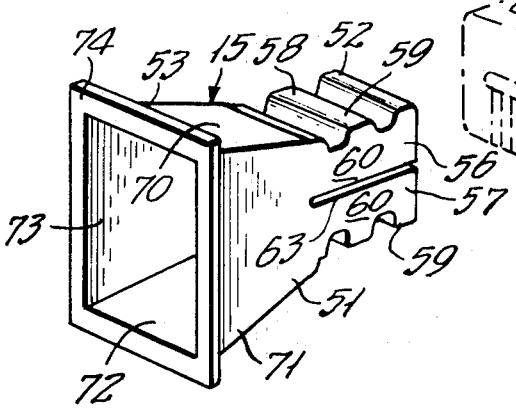
FIG. 3 is an exploded view in perspective of a second embodiment of the invention.
Figure 3:
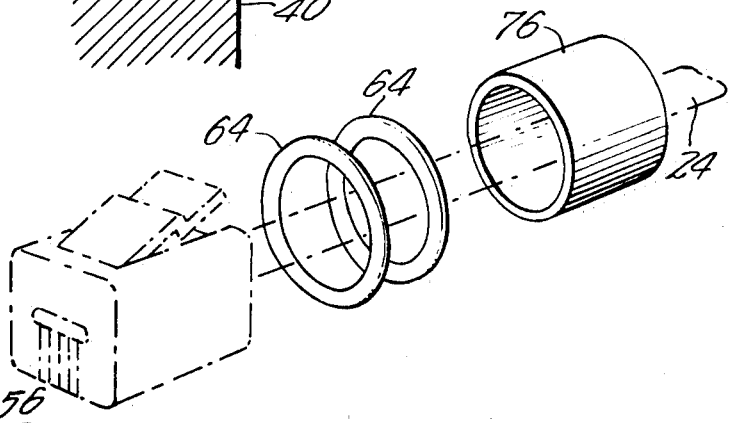
Figure 4:
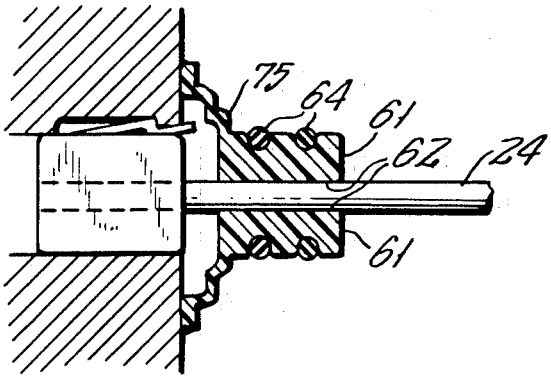
FIG. 4 is a longitudinal central sectional view of the second embodiment.

Each of the members 14 and 15 are similar and symmetrical being bounded by an outer surface 19, a pair of end surfaces 20, a pair of side surfaces 21, an inner surface 22, and a rectilinear flat channel 23. As best seen in FIG. 2, the channel 23 is adapted to partially surround the usual flat conductor 24 which interconnects a plug element with a telephone handset (not shown).

The outer boot element 12 is of generally hollow rectangular configuration, and is of considerably thinner cross-section so as to possess a substantial degree of stretchability. It is bounded by first, second, third and fourth side walls 27, 28, 29 and 30, respectively. The walls forming continuous end edges which interconnect with first and second laterally extending end flanges 31 and 32 respectively. The flanges 31-32 form planar end surfaces 33.

FIG. 2 illustrates the installation of the first embodiment upon a convention RJ 11 plug 36, and the relative condition of the parts when the plug is installed in a rectangular recess 37 in the corresponding jack element 39. Installation may be performed by the subscriber by merely placing the two halves of the inner boot element 11 on the conductor 24 adjacent the rear end of the plug 36, and maintaining this position while the outer boot element 12 is pulled over the leading edge of the plug 36. In fully seated position, the outer boot element will engage the outer surfaces 19 of the element 11 and maintain them in clamped condition upon the conductor 24. With engagement of the plug in the recess, the first flange 31 will be pushed rearwardly as it contacts the planar surface 40 surrounding the opening in the jack element. The resilient resistance will assure a snug fit which completely surrounds the jack opening. The outer boot element 12 will flex under the action of the latch lever 42, which may be manually depressed through the boot should it be desired to disconnect the plug from the jack.

Turning now to the second embodiment of the invention, generally indicated by reference character 15, this embodiment differs from the first embodiment 10 principally in the fact that the structure equivalent to the inner and outer boot elements 11 and 12 are molded integrally.

The unitary molding 51 includes a first boot element 52 and a second boot element 53. The boot element 52 includes first and second separable members 56 and 57, each including an outer surface 58 having parallel ribs 59 as well as side surfaces 60, end surfaces 61 and inner surfaces 62 forming rectangular channels 63. The first boot element is maintained in closed condition about the conductor 24 by elastic bands 64 which are merely manually moved to engage the interstices between the ribs 59.

The second boot element 53 resembles the outer boot element 12, and includes a plurality of side walls 70,71, 72 and 73 as well as a single end flange 74. The opposite side wall 75 is of tapered configuration to interconnect with the first boot element 52.

The installation of the second embodiment is performed by spreading apart the members 56 and 57, and physically pulling the entire device over the lead end of the plug 36 until the end wall 75 overlies the tail end of the plug. The resilient bands 64 may then be applied in a similar fashion, or, preferably, they were previously slipped over the plug to lie upon the conductor until the separable members 56 and 57 are positioned. Finally, an optional rubber collar 76 is moved to overlie the bands 64 to achieve a neat appearance.

We wish it to be understood that we do not consider the invention limited to the precise details of structure shown and set forth in this specification, for obvious modifications will occur to those skilled in the art to which the invention pertains.

We claim:

1. An improved protective boot for effecting a seal in the area of interconnection of a mutually engaged telephone subscriber jack and plug comprising: a first boot element of relatively thick cross-section including first and second abutting members adapted to surround a flat electrical conductor engaged with a rear end of said plug, said first boot element being of rectangular configuration; a second boot element of relatively thin cross section of generally rectangular configuration, and defining a recess corresponding in configuration to the outer configuration of said plug, said second boot element having a laterally extending peripheral flange surrounding an engaged plug when in installed condition, movement of said plug into engagement with said jack serving to distort said second boot element to effect a sealing action against a transversely extending surface of said jack surrounding a plug opening therein; said first and second boot elements in engaged condition being in juxtaposed relation to effect a seal in the area of interconnection between said conductor and said plug.

2. An improved boot in accordance with claim 1, further characterized in said first and second abuttable members of said first boot element being interconnected by a captive hinge; said second boot element resiliently engaging both said first boot element and said plug.

3. An improved boot in accordance with claim 1, in which said first and second boot elements are integrally molded.

4. An improved boot in accordance with claim 3 further comprising at least one resilient constrictive band surrounding said first element to clamp the same on said flat conductor.

* * * * *